US006219843B1

(12) United States Patent
Passi et al.

(10) Patent No.: US 6,219,843 B1
(45) Date of Patent: Apr. 24, 2001

(54) PROTECTIVE DEVICE, SPECIFICALLY ADAPTED TO SKATING

(75) Inventors: Gérald Passi, Lignan sur Orb (FR); Antti Kärävä, Espoo (FI)

(73) Assignee: Salomon S.A., Metz-Tessy (FR)

( * ) Notice: Subject to any disclaimer, the term of this patent is extended or adjusted under 35 U.S.C. 154(b) by 0 days.

(21) Appl. No.: 09/353,337

(22) Filed: Jul. 15, 1999

(30) Foreign Application Priority Data

Jul. 16, 1998 (FR) ..... 98 09249

(51) Int. Cl.[7] ..... A41D 13/08

(52) U.S. Cl. ..... 2/16; 2/455; 2/24; 602/21; 128/879

(58) Field of Search ..... 2/20, 16, 19, 455, 2/22, 24, 159, 161.1, 910; 128/878, 879; 602/20, 21

(56) References Cited

U.S. PATENT DOCUMENTS

| | | | | |
|---|---|---|---|---|
| 3,551,912 | | 1/1971 | Viglione . | |
| 4,190,902 | | 3/1980 | Rhee . | |
| 4,556,992 | | 12/1985 | Drury . | |
| 5,222,256 | | 6/1993 | Wang . | |
| 5,255,391 | | 10/1993 | Levine . | |
| 5,407,421 | * | 4/1995 | Goldsmith | 602/5 |
| 5,526,531 | | 6/1996 | Olson et al. . | |
| 5,566,389 | * | 10/1996 | Li | 2/16 |
| 5,600,849 | | 2/1997 | Hu . | |
| 5,611,080 | | 3/1997 | Skottheim . | |
| 5,685,013 | | 11/1997 | Hausman . | |
| 5,711,029 | | 1/1998 | Visco et al. . | |
| 5,727,252 | | 3/1998 | Oetting et al. . | |
| 5,819,313 | * | 10/1998 | McCrane | 2/16 |
| 5,983,408 | * | 11/1999 | Li | 2/455 |
| 5,987,641 | * | 11/1999 | Walker | 2/16 |

FOREIGN PATENT DOCUMENTS

| | | |
|---|---|---|
| 2120176 | 12/1994 | (CA) . |
| 9412960 | 11/1994 | (DE) . |
| 295 10 932 | 11/1995 | (DE) . |
| 297 17 989 | 4/1998 | (DE) . |
| 0631735 | 1/1995 | (EP) . |
| WO97/27768 | 8/1997 | (WO) . |

* cited by examiner

*Primary Examiner*—John J. Calvert
*Assistant Examiner*—Tejash Patel
(74) *Attorney, Agent, or Firm*—Greenblum & Bernstein, P.L.C.

(57) ABSTRACT

A protective device for at least two projecting parts of a limb, which parts extend outwardly in separate angular planes, the device including a flexible body at least partially surrounding the limb; a protection element made of a rigid or semi-rigid material locally distributed on the flexible body; an attachment system for the protection element on the flexible body; and a tightening element of the flexible body around the limb. The protection element includes at least one first part and one second part connected to one another by an articulation allowing a forced adjustment of the parts of the protection element with respect to the projecting parts to be protected when the tightening element is activated during tightening. The invention finds its application in protective devices used in skating, such as in-line skating, roller skating, or other similar sports.

28 Claims, 6 Drawing Sheets

PROTECTIVE DEVICE, SPECIFICALLY ADAPTED TO SKATING

BACKGROUND OF THE INVENTION

1. Field of the Invention

The invention is related to a device for protection against falls, and is specifically adapted to sports, like roller skating, in-line roller skating, and skateboarding.

2. Description of Background and Relevant Information

During skating, it is important to have substantial freedom of movement so as to be able more effectively to perform jumps and figures, and furthermore, to execute braking or acceleration related movements. Skating-related risks occur due to the fact that when the skater loses his balance, he may fall down on hard and non shock-absorbent surfaces that can cause serious injuries. Therefore, protective accessories were designed with the object of limiting the risks of injury, especially in the most vulnerable areas, i.e., the head, hands, knees, and elbows.

The drawbacks that are often cited in connection with existing protective accessories are that they provide inadequate protection, either because their designs are usually non-specific, or because they are too cumbersome, thereby limiting the mobility of the limbs, being too hot, and affecting both the smoothness of the motions, and the artistic or aesthetic appearance while skating. In terms of protection, the proposed systems do not give enough importance to the fact that the parts to be protected in any one zone, generally projecting parts, can be numerous and oriented in different planes with respect to one another. Thus, more often than not, the protection is either effective only in one specific plane while remaining ineffective or inadequate in another plane, or else the protection works effectively in all planes, but this is achieved at the price of a device that is much too cumbersome.

Existing systems are also usually complicated and take a long time to put on; this makes them troublesome to use for all occasions, especially when just a short session or one with no apparent difficulties is being planned. However, it is precisely on such occasions that accidents occur most often.

Therefore, there exists a need to improve current systems with the object of (1) making such systems better adapted to the morphology of the body parts to be protected, (2) reducing volume to promote mobility and, (3) facilitating the ease with which such systems can be worn so that their use becomes mandatory.

International Patent Application WO 97/27768 is related to a wrist and hand protective device that consists of a stiffening element extending from the palm of the hand to below the wrist joint. The stiffening element is slipped into the flexible pocket of a band having a planar configuration. The band is positioned by winding it around the wrist, and it is tightened by means of a strap equipped with a Velcro type attachment.

Utility Design DE-UI-297 17 989 is related to a knee protective device consisting of a flexible, appropriately shaped part, on which a stiff plastic shell is fixed. The flexible part is attached to the leg by two straps, each arranged on either side of the knee joint.

U.S. Pat. No. 5,526,531 is a wrist protection consisting of an elongated I-shaped reinforcement connected to the arm via two straps. The reinforcement is extended via a stiff thumb protection finger.

U.S. Pat. No. 5,685,013 is related to a hand, wrist, and forearm protective device. The device, which covers a substantial portion of the forearm via stiffening elements connected by straps, is very cumbersome and limits the mobility of the arm and the hand.

U.S. Pat. No. 5,255,391 is related to a knee protection sleeve consisting of a flexible body, padding means made of a resilient material and detachable affixing means for fixing the sleeve around the knee, having two affixing flaps surrounding the leg from each side of the knee.

Patent Application CA 2,120,176 is related to a knee protective device that promotes the bending of the knee by means of two separate shell portions that are capable of pivoting about a horizontal axis. Still, the only object of the shells is to protect the knee cap and, when tightened, they cannot be adjusted to protect the other distinct projecting parts of the knee.

Other related documents concern other protective devices, such as U.S. Pat. No. 4,190,902 and U.S. Pat. No. 5,611,080.

A wrist protection system is also known that is marketed under the trademark BiomeX-Protection which consists of two preformed stiff parts that are articulated in the area of the wrist so as to promote its mobility. One of these parts has the object of protecting the palm of the hand whereas the other covers the inner portion of the forearm. The stiff parts are simply covered with a fine layer of foam glued onto the base of the preformed parts. It is tightened by means of two longitudinally spaced straps. Therefore, the device cannot be easily conformed or adapted to the size of the hand due to the fact that the structure is very rigid and the position of the articulation does not allow any clearance for its shape or size. Such a device is also cumbersome, and putting it on is a laborious task.

SUMMARY OF THE INVENTION

One of the main objects of the instant invention is therefore to overcome the aforementioned drawbacks and propose a protective device that would include significant improvements. In order to achieve this, the invention is related to a protective device for at least two projecting members of a limb, such members projecting into separate angular planes, and includes:

- a flexible body, at least partially surrounding the member;
- a protection element made of a rigid or semi-rigid material distributed locally over the flexible body;
- an attachment system for the protection element on the flexible body; and
- an element for tightening the flexible body around the limb;
- wherein the protection element has at least one first part and one second part connected together via an articulation allowing a forced adjustment of the parts of the protection element with respect to the projecting members to be protected when the tightening element is activated during tightening.

Thus, the device according to the invention better accommodates the morphology of the zone to be protected by being adapted thereto during tightening, while reducing its volume to a minimum.

The device according to the invention can be related to a device adapted to protect the hand. In this case, the projecting members being targeted more specifically are the palm and the edge of the hand.

The invention could also be embodied as a device adapted to protect the knee. In this case, the targeted body members are the knee cap and the head of the fibula.

In all cases, the body members to be protected project outwardly into planes that form a certain angle with respect to one another. The object of the invention is achieved due to the design of the articulated parts of the rigid protection element that are adapted, during the tightening of the device, around the limb to be protected.

Another object of the invention is related to a protective device for the hand that provides optimum protection while leaving the articulation zones free. For this, the invention includes:

- a flexible body having a palm portion and a back portion, at least partially surrounding the user's hand;
- a protection element formed of a rigid or semi-rigid material locally distributed over the palm portion of the flexible body, the device being demarcated width-wise by a first transverse edge located below the phalangeal joints and a second, opposing transverse edge located in the vicinity of the wrist joint.

Thus, the device provides optimum protection of the hand, and specifically of the palm, without affecting the mobility of the joints, i.e., the wrist joint and the finger joints. Such a device also has the advantage of being positioned more easily and rapidly as compared to the existing prior art devices due to the fact that the fingers are left free, unlike mittens or protective gloves.

Another object of the invention is to propose a protective device whose shock absorption is improved with respect to the known prior art devices. In order to achieve this, the invention includes:

- a flexible body that at least partially surrounds the limb;
- a pressure distribution element made of a rigid or semi-rigid material locally distributed over the flexible body;
- a padding located between the flexible body and the pressure distribution element;
- wherein the padding includes a closed volume filled with a gelled, non-compressible material.

BRIEF DESCRIPTION OF DRAWINGS

The advantages of the invention, as cited hereinabove, as well as others will be explained in the following detailed description with the help of the drawings that illustrate the preferred embodiments.

DETAILED DESCRIPTION OF THE INVENTION

Figure 1:
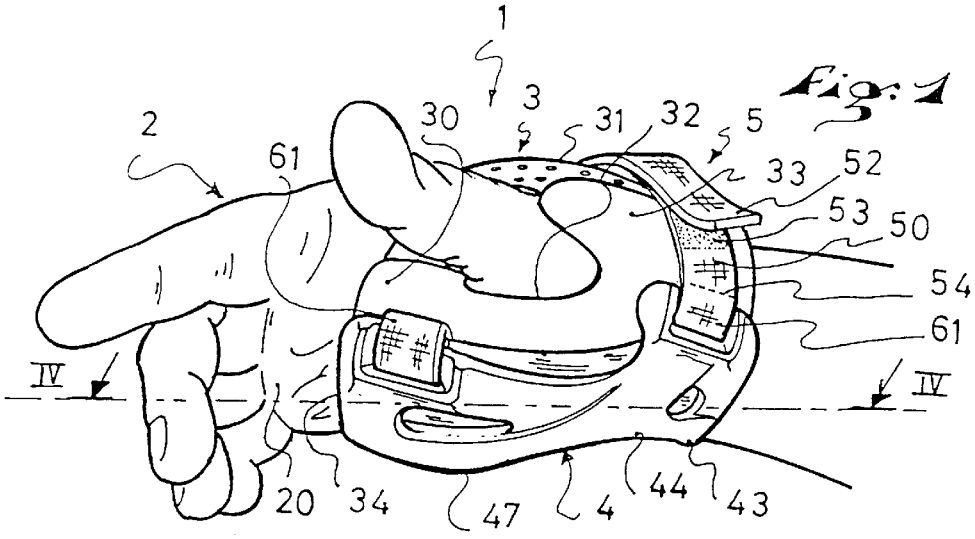
FIG. 1 is an inner side view of a hand, such hand wearing the protective device according to the invention.
Figure 2:
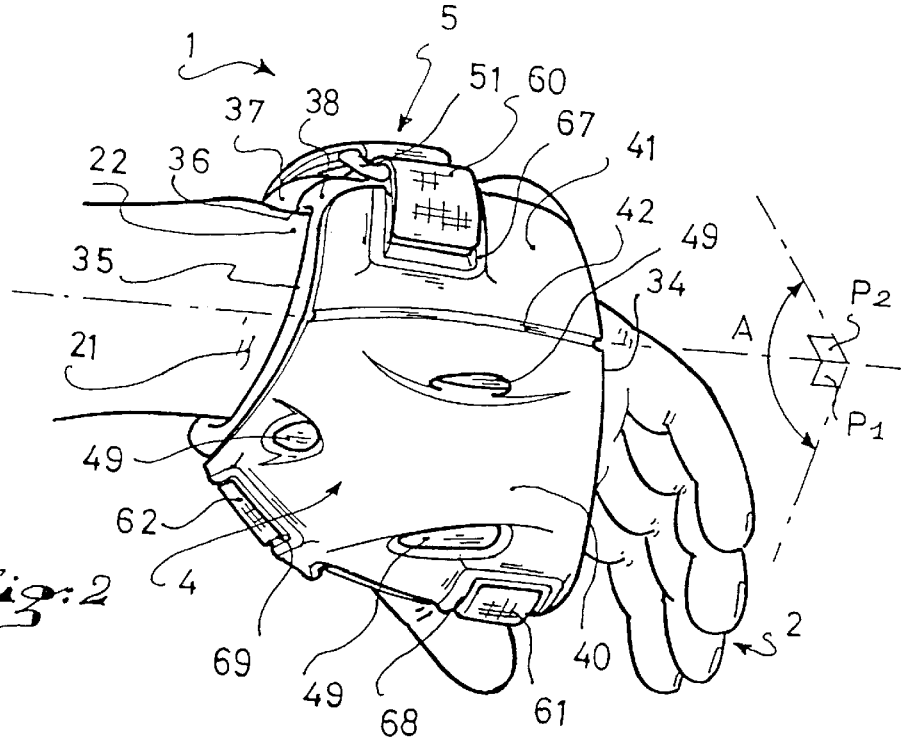
FIG. 2 is an outer side view of the hand, such hand wearing the protective device according to the invention.
Figure 3:
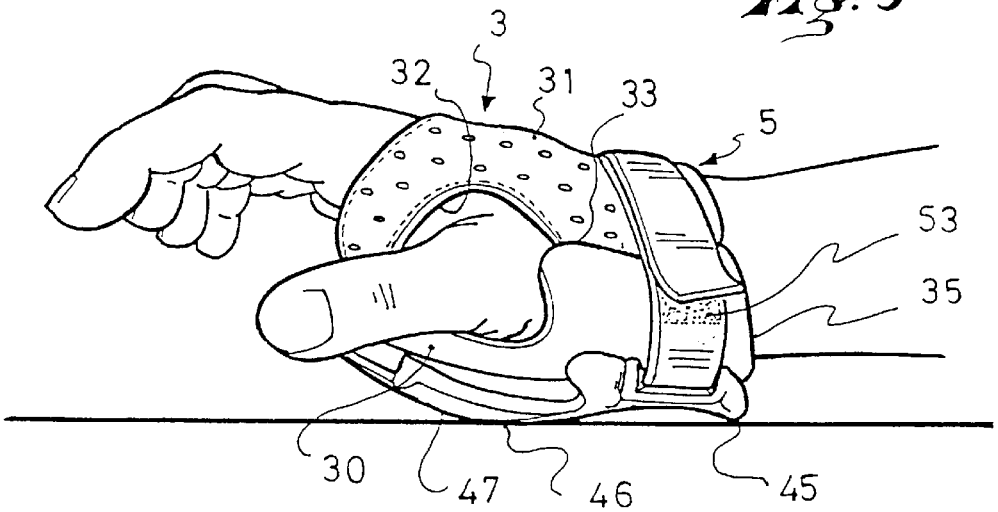
FIG. 3 is a side view of the device of FIGS. 1 and 2 of the invention when it comes in contact with the ground.

The device 1 of the invention is specifically adapted to protect a hand 2 as illustrated in FIGS. 1 to 3. The device includes a main flexible and pliable part 3 having a palm portion 30 and a back portion 31 surrounding the user's hand. The body forms a flexible sleeve around the hand and has an opening 32 for the passage of the thumb. The opening is located at a first junction 33 between the palm portion and the back portion of the flexible body. The device is limited in transverse volume, on the one hand, by a first transverse edge 34 located just behind the first phalangeal joints 20 and, on the other hand, by a second transverse edge 35 located in the vicinity of the wrist joint 21.

It is to be understood that the device allows great freedom of movement to the hand, which is useful while skating, especially during so-called "aggressive" skating, or skate boarding, where the practitioners need to grab their rolling devices while executing jumps or acrobatics. It should be noted that the device is also different from other wrist protective devices that are more particularly adapted to novice skaters, where an improperly controlled rear balance can cause rearward falls and lead to injuries connected to the hyper extension of the wrists. The device of the invention has the object of providing a light hand protection so as to prevent the injuries that occur during falls or skids to the front or the side which are frequent, regardless of the level of the skater's competence.

The main function of the flexible body 3 is to ensure a good enveloping of that portion of the hand that it covers by providing good retention and good comfort. On the other hand, the device has a protection element 4 made of an abrasion-resistant rigid or semi-rigid material arranged externally and locally distributed along the palm portion 30 of the flexible body 3. The element 4 ensures protection against shocks by distributing the pressure. Being located on the outside, it also has the role of protecting the hand from friction, or abrasion, with the ground.

The element 4 has a main part 40 that substantially covers the palm and a side part 41, extending up to the area of a second junction 36 between the palm portion and the back portion of the flexible body. This junction 36 is arranged across from the edge area 22 of the hand. The parts 40, 41 are connected together by an articulation 42 that promotes the orientation of the parts 40, 41 substantially along their respective separate protection planes P1, P2 forming an angle A, after the device is tightened on the hand. Specifically, the main part 40 and the secondary part 41 are connected via a transverse cross-section reducing zone extending substantially from the first transverse edge portion 34 to the second transverse edge portion 35 of the device. The articulation could be obtained differently, such as via mechanical means that are separate from the parts of the protection element. The articulation could also be multiple in the transverse direction so as to refine the shape of the parts to the morphology of the hand.

The tightening of the flexible body 3 is ensured by a tightening element 5. Preferably, the tightening element has a quick attachment system. It is advantageous to arrange the tightening element in the back area of the hand for ease of handling. The back portion 31 has a discontinuity formed by a first free end 37 and a second free end 38 that are connected together via the quick attachment system. The first free end 37 and the second free end 38 are connected together by a buckle/strap assembly. A strap 50 is attached on one of the ends 37. A buckle 51 is attached on the opposing end 38 to allow the return of the strap 50. A quick detachment affixing element 53 made of Velcro, or another similar hook and loop fastening material, ensures the affixing of the free end 52 of the strap with the back portion. The strap 50 is made of a flexible and traction resistant material.

Preferably, such material is non-extensible, although a part or its entirety can be made of an elastic material allowing limited stretching.

Figure 4:
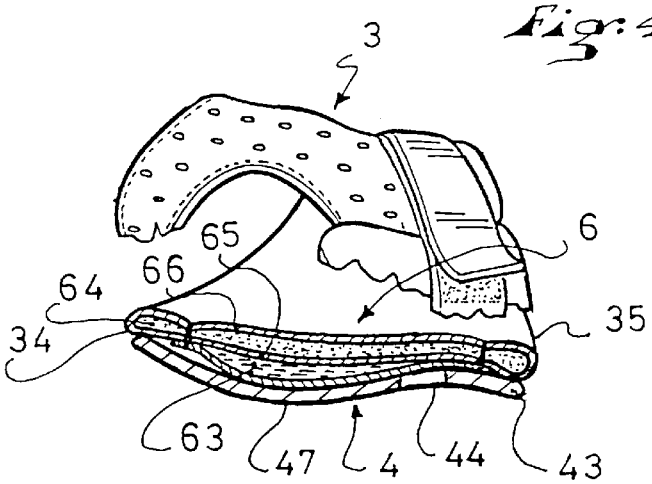
FIG. 4 is a partial cross-sectional view of the device taken along line IV—IV of FIG. 1.

As can be seen from FIG. 4 preferably, the flexible body 3 has a padding 6 located under the rigid or semi-rigid element 4. The padding has the object of absorbing shocks during a fall and improving the comfort of the device. Preferably, the padding has at least one zone demarcating a closed volume 63 filled with a non-compressible, gelled material, such as a silicone polymer or polyurethane based material. Such a padding significantly improves shock absorption in case of a fall and is better, at any rate, than the padding used traditionally in these types of devices. The physical state of the material is such that its properties are between a solid and a liquid. It is made of a three-dimensional network structure dispersed in a homogeneous liquid phase in which the phases mutually penetrate each other. The material is used for its substantial flow capacity at a given speed, allowing for pressure distribution and absorption of the shock energy. The gel is preferably contained in an envelope made of a hermetically sealed film, like a polyurethane film. The thickness of the envelope containing the gel can vary between 3 and 12 millimeters depending on the requirements. The thickness can be increased selectively to protect the knee, for example, where the shocks are more violent because of the falling mass, than would be the case for protecting the hand where the mass is less. The combination of the protection element 4 and a gel layer 63 is an important characteristic of the invention. Indeed, the protection element takes the role of a pressure distribution plate, such pressure being partially absorbed thereafter by the gel layer.

The padding can also be supplemented by one or several layers of foam 64 protected between two superposed fabric layers 65, 66. A few millimeters thickness of a polyurethane or polyethylene based foam provides a good absorption in addition to the gelled material layer. It is also the object of the foam to provide better comfort and enveloping of the part requiring protection.

According to another interesting characteristic of the invention, the rigid or semi-rigid protection element has a lower edge 43 that curves inwardly so as to form a concave channel 44 extending close to the edge 43 and being substantially parallel thereto. The lower edge 43 of the rigid element is itself located in the vicinity of the wrist joint or even in the vicinity of the first transverse edge 35 of the device. During a fall, the function of the channel 44 is to keep the hand in a raised configuration. As shown in FIG. 3 more specifically, when the device comes in contact with the ground, the channel substantially forms two contact zones 45, 46, separated transversely, on which the hand takes support near the wrist. Thus, the fingers remain raised with respect to the ground. The effect is even more efficient due to the fact that the channel is extended transversely along the remainder of the protection element via a convex surface 47. The effect of this convex surface is to bring the hand back into support on the channel, keep the fingers raised with respect to the ground and, therefore, protect them when the user slips on the ground.

Generally speaking, the geometry of the device takes the shape of the palm of the hand into account. Thus, the first transverse edge 34 and the second transverse edge 35 flare transversely with respect to one another from the edge area of the hand in the direction of the thumb area. This progressive flaring is substantially in proportion with the natural broadening of the palm of the hand.

Preferably, the rigid or semi-rigid element 4 is not connected over its entire surface to the surface of the flexible body for reasons of the compatibility of the attachment system and the flexibility of the device. Nevertheless, the rigid or semi-rigid element is locally connected to the flexible body. In particular, it is important that the main part 40 and the secondary part 41 be connected independently to the flexible body such that when the flexible body is tightened around the hand, the parts 40, 41 can be oriented and adjusted to the size of the hand. Therefore, one preferred solution consists of making sure that the rigid or semi-rigid protection element is connected via loop forming bands 60, 61, 62 fixed to the flexible body and passing through the slots 67, 68, 69 arranged on the edges of the protection element. For example, the end of the secondary part 41, whose width is small, is connected via a band 60 to the flexible body; whereas the end of the main part, which is broader, has two transversely spaced affixing bands 61, 62. The buckle 51 of the tightening element 5 can advantageously be connected to the free end 38 by the band 60 which thus ensures a dual function. Similarly, on the other side of the device, the attachment band 61 of the protection element is extended to form the band 50 of the tightening element 5. The affixing of the band 50, 61 on the flexible body can be ensured, preferably, by a stitch 54.

The flexible body is preferably made of a breathable material, such as fabrics, foams, leather, or combinations of these materials. The use of perforated or large mesh elastic fabrics is preferred in the non-padded zones in direct contact with the hand so as to promote its retention and breathability, as on the back portion 31. In the padded zones, flexible and less stretchable fabrics are preferred that are absorbent and comfortable to the touch. The flexible body is preformed after making an appropriate template, then cut off and assembled by stitching and/or gluing.

Figure 5:
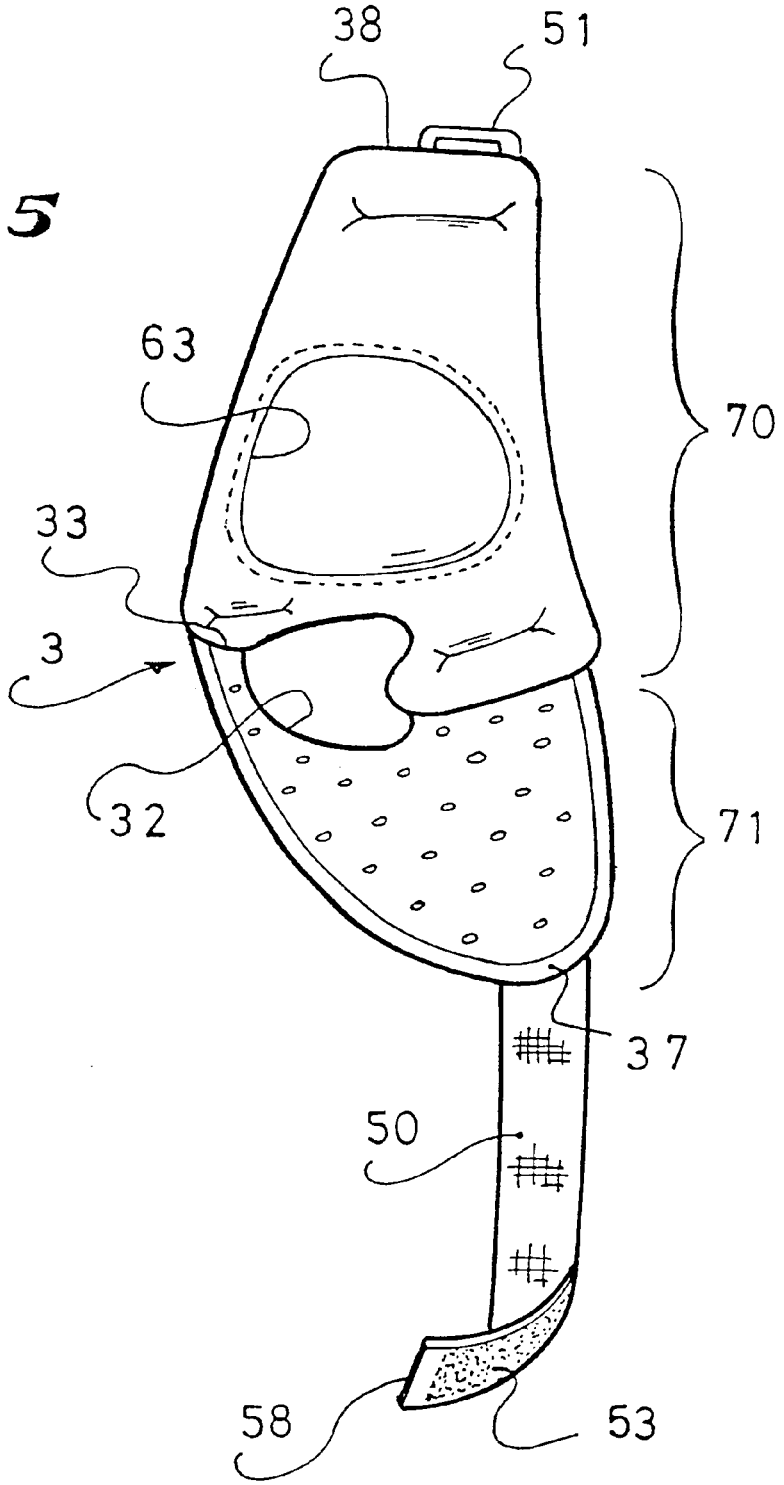
FIG. 5 is an inner view of the device placed flat.

FIG. 5 shows the device in an open configuration when the strap 50 is detached from the buckle 51. In its design, the flexible body has a first part 70 having a trapezoidal shape and equipped with padding, and a substantially triangular second part 71 made of a finer textile material, preferably a light fabric. Both parts 70, 71 are assembled at the junction line 33 in the area of the thumb opening 32. The first part looks like a fabric pouch. It forms the palm portion 30 and extends up along the sides to form a part of the edges of the back portion of the hand. Substantially at the center of the part 70, a yoke corresponding to the gel layer 63 is attached. The yoke can be arranged either on the inner surface of the part 70 in contact with the hand as illustrated in FIG. 5, or between the part 70 and the protection element 6, as is the case in FIG. 4. In all cases, this yoke is preferably connected by stitching on the flexible body. The foam padding preferably extends beyond the contours of the yoke and covers the entirety of the pouch forming the part 70.

As for the protection element, it is made of a plastic, metallic or rubber material. Preferably, it relates to a mold injection plastic, such as a polyurethane, polypropylene or polyamide plastic. The plastic can be fiber-reinforced to increase its resistance. It can also be a thermoset plastic, such as an epoxy or a fiber-reinforced polyester. It can also be an aluminum plate. It can be provided for the protection element to have holes 49 so as to encourage ventilation and air circulation through the device.

Figure 8:
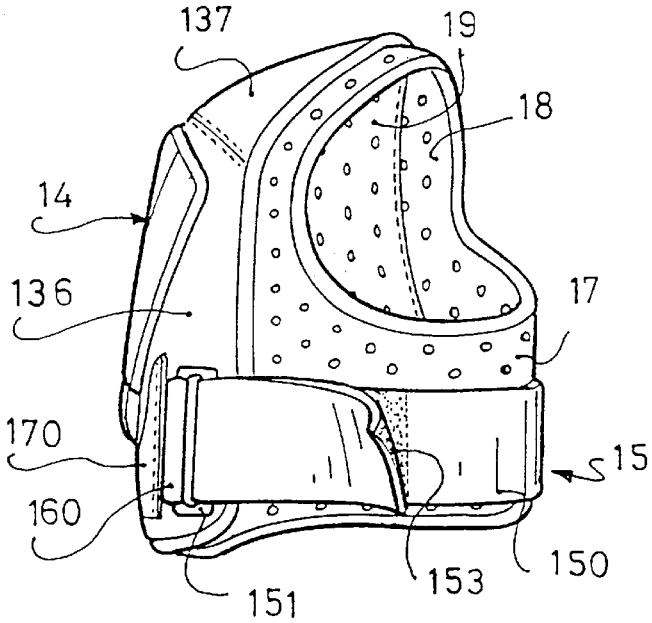
FIG. 8 is a rear view of the knee device of FIG. 6 according to another embodiment.
Figure 7:
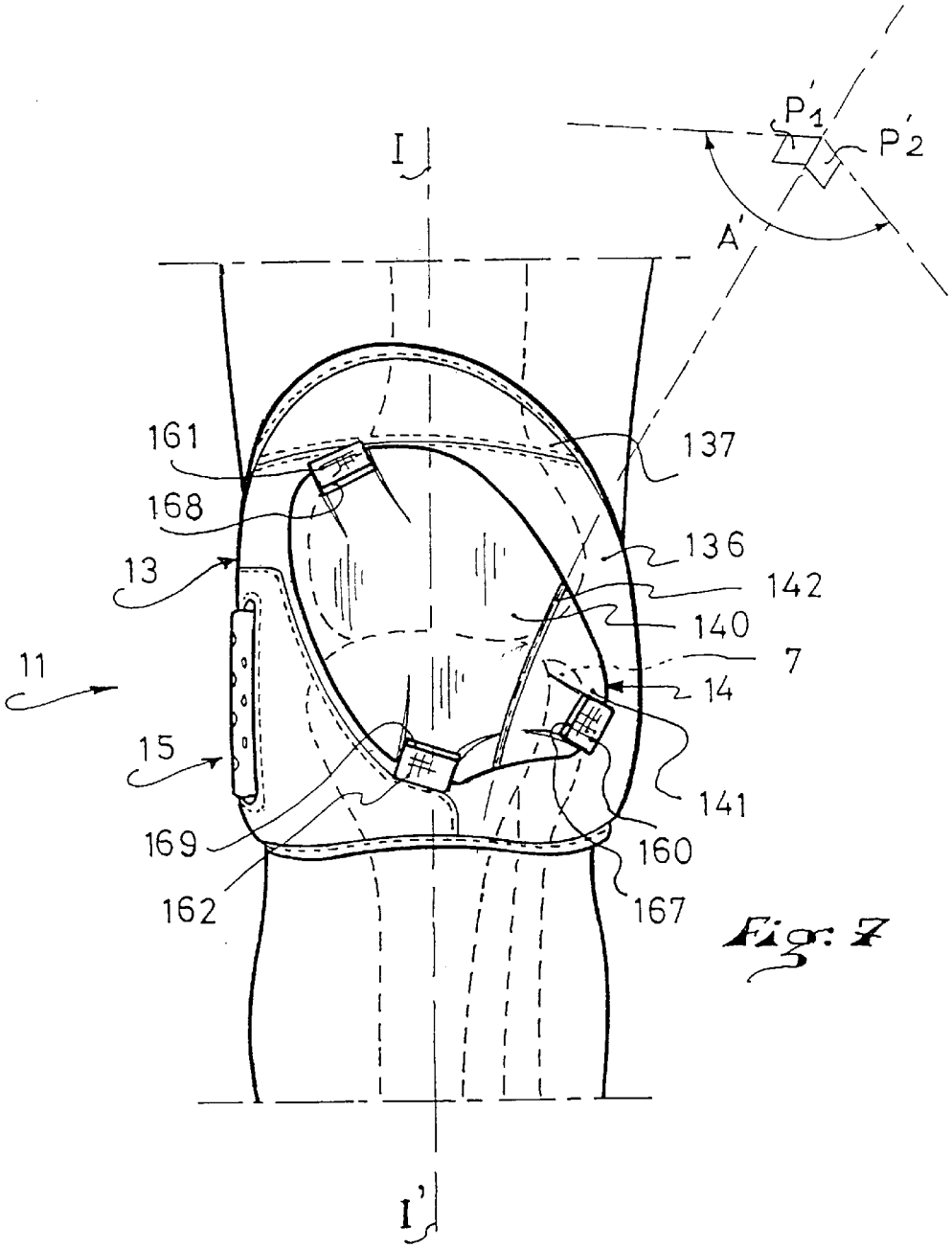
FIG. 7 is a front view of the knee protective device of FIG. 5.

The invention can also be related to other protective accessories related to other body parts. In another preferred embodiment of the invention illustrated in FIGS. 7 to 8, the device is used to protect the knee and, more specifically, the knee cap and the head of the fibula, both of these being projecting parts that are particularly exposed during a fall while skating. Another specificity of these parts is that they extend in different planes; the knee cap being substantially in the longitudinal plane I–I' of the leg whereas the head of the fibula is located in a plane offset towards the side by an angle close to 90 degrees with respect to the longitudinal plane. FIGS. 7 to 8 show detailed views of the proposed knee protective device in its preferred embodiment. For purposes of simplification, the same reference numerals will be used to designate the same means in the drawings, a prefix "1" having been added thereto. Thus, the device will have the reference numeral 11, the flexible body will be designated by the reference 13 and the rigid or semi-rigid protection element will be designated by the reference numeral 14 and so on.

Shock protection is ensured by the protection element 14 that includes two separate parts 140, 141 that are articulated together. The main part 140 has a substantially ovoid and slightly bulging shape in order to cover the knee cap. The secondary part 141 whose object is to cover the head of the fibula 7 is offset laterally and downwardly with respect to the position of the main part 140 on the device. The parts 140, 141 are connected together via a section reducing line 142 extending in an inclined manner with respect to the longitudinal plane I–I' of the device. The inclination can vary between approximately 0 and 90 degrees. The line is not necessarily perfectly rectilinear and a certain amount of curvature can be tolerated.

The flexible body 13 on which the protection element 14 is affixed at three spots consists of a preformed first portion 136 and a preformed second portion 137 extending the first vertically and forming an edge adapted to cap the upper part of the knee cap so as to improve the retention of the device on the knee. This special geometry allows using only one tightening element 15, preferably located at the base of the first preformed portion 136. The tightening element is a strap of the same type as in the previous embodiment. The strap is provided to surround the top of the calf just below the knee joint. The use of a single strap has numerous advantages. Among other things, the positioning of the device becomes much quicker. Also, bending the leg in the area of the knee causes no problems and does not disturb the application of the device on the knee as can be the case with two straps that are arranged on either side of the joint.

As shown more specifically in FIG. 8, the retention of the device can advantageously be complemented with a rear stretchable retention band 17, preferably attached by stitching, on either side of the front portions 136, 137. Preferably, the band forms a continuous elastic sleeve equipped with an upper cut-out 18 for the passage of the leg. The band includes an inner portion 19 adapted to be adjusted when it comes in contact with the knee, and covers the inner surface of the front portions 136, 137. The tightening element 15, formed by the strap 150, the buckle 151, and the Velcro assembly 153, transversely surrounds the stretchable band so as to ensure its adjustment to the size of the stretchable band. The strap 150 is preferably attached to one of the edges of the front portion, since the buckle 151 is attached to the opposite portion by means of a strap portion 160 fixed on the front portion 136. Preferably, the strap cannot be stretched much or is non-extensible. A traction reinforcement yoke 170 is advantageously stitched to the base of the strap portion 160 so as to improve its resistance to traction. The function of the stretchable band is to improve comfort and the retention in place of the protective device. The band 17 preferably has ventilation holes that promote the evacuation of perspiration.

A padding 16 similar to the one described in the previous embodiment can also be arranged between the protection element and the flexible body in order to improve shock absorption in case of a fall.

The rigid or semi-rigid protection element 14 is preferably attached to the body 13 by loop forming bands 160, 161, 162 that pass through slots 167, 168, 169 provided in the protection element. The connection elements 161, 162, 168, 169 of the main part 140 are separate from the connection elements 160, 167 of the secondary part 141; this allows the positioning of the parts 140, 141 with respect to the projecting parts to be protected during the tightening of the tightening element 15. The parts adopt the protection planes P'1, P'2 which form a certain angle A' with respect to one another depending on the specific morphology and size of each person.

Figure 6:
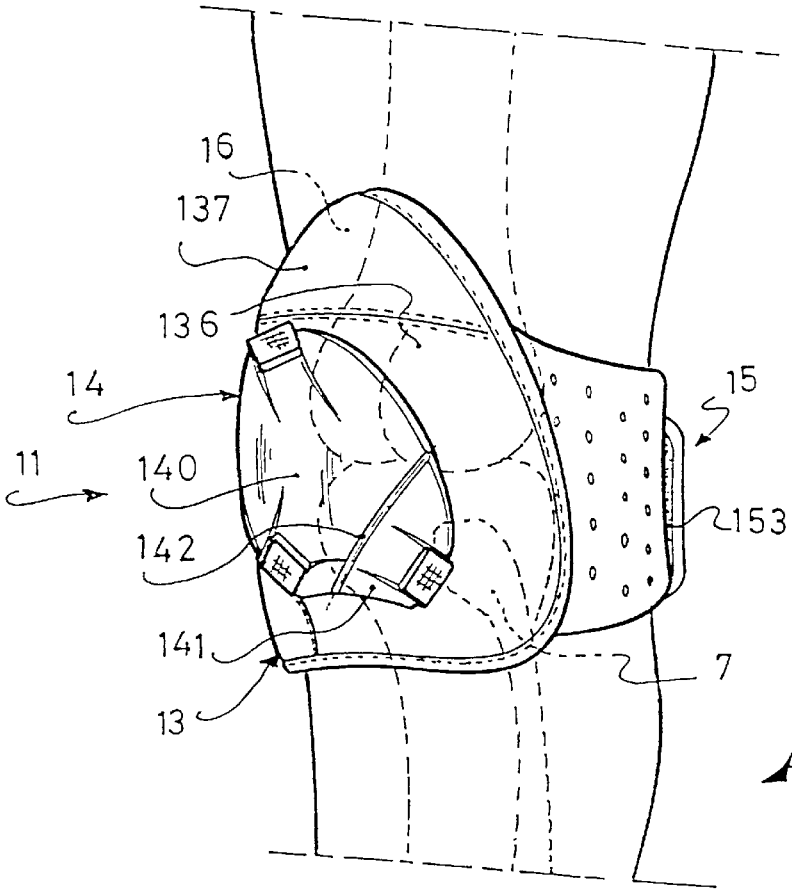
FIG. 6 is an outer side view of a knee protective device according to the invention.

Energy absorption measurement tests have been performed to evaluate the efficiency of the protective device of the invention having the padding of the invention by comparing it to a similar device having a traditional foam-based padding. For this, the measured device of the invention included a knee protective device having a padding gel of a thickness of about 10 mm, such as described in reference to FIGS. 6 and 7. Then the device was measured without the padding gel. The test was based on the vertical fall of a mass of 5 kilograms on the device which covered a hemispherical shaped anvil (having a diameter of 100 mm) and was connected to a force sensor. The mass covered a distance of 296 mm before impact, resulting in an impact speed of 2.4 m/s (meters per second). The value of the maximum force to which the anvil was subjected was recorded after filtering out vibrations. For the device of the invention, a maximum force value of about 4350 N (Newtons) was measured. The value for a device without the padding of the invention was measured comparatively at about 30,000 N. It should therefore be noted that the padding according to the invention provides a very significant absorption of the pressure crests during an impact and therefore provides a particularly effective protection.

Figure 9:
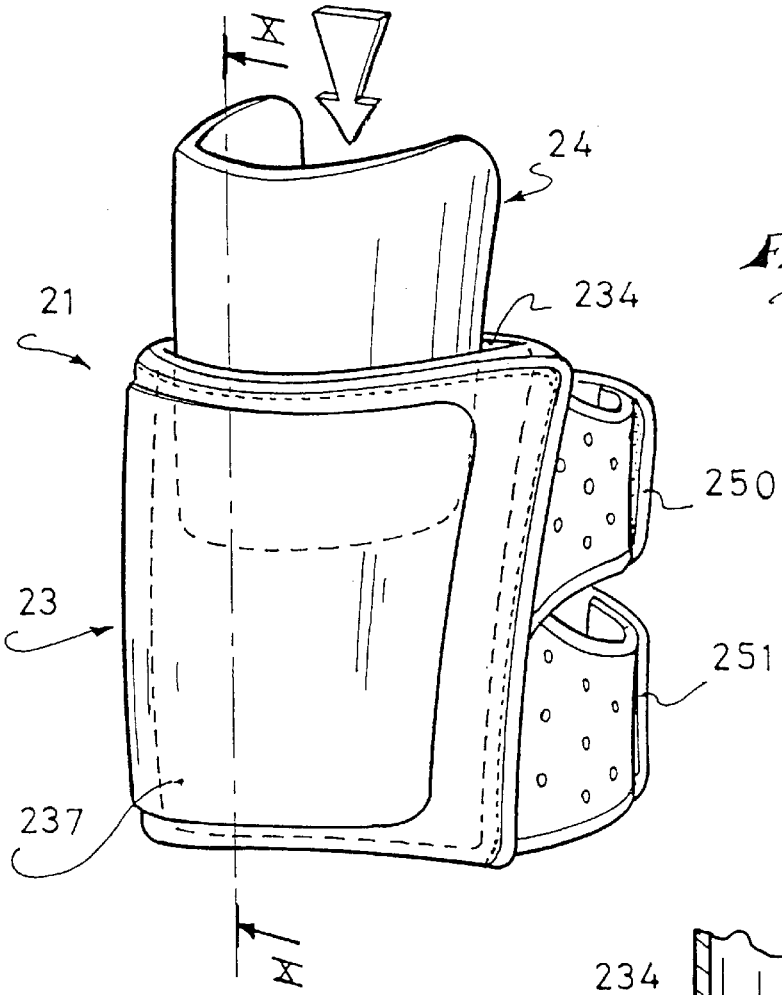
FIG. 9 is an outer side view of a variation of a knee protective device according to another embodiment of the invention.
Figure 10:
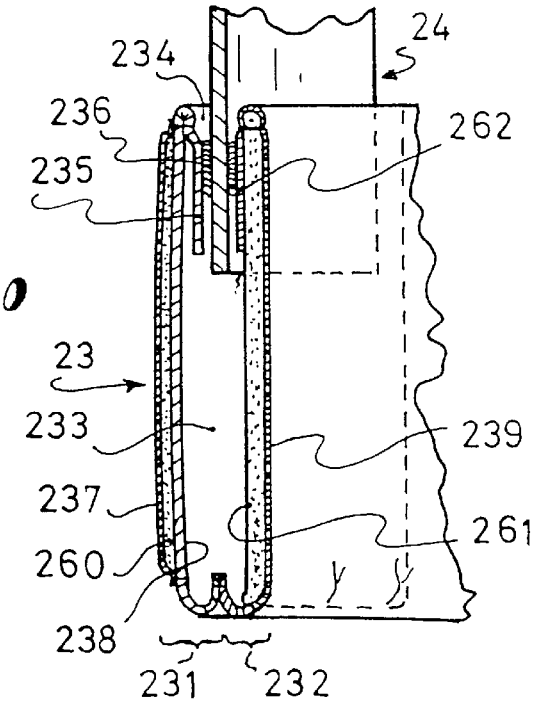
FIG. 10 is a cross-section taken along line X—X of the view of FIG. 9.

FIGS. 9 and 10 illustrate another embodiment of the invention. The device includes a flexible body 23 and a rigid or semi-rigid inner distribution element 24 hidden inside the flexible body through a pouch 233 having an opening 234. The pouch is made of two foldable flaps 231, 232 whose edges are attached to one another by any appropriate means, preferably by stitching, leaving one side free, preferably the upper side forming the opening 234 for the passage of the distribution element 24. The element 24 is kept in place inside the pouch 234 by at least one inner fold 235 under which a portion of the element 24 is slipped. This fold can be a part of the front flap 231 as illustrated in FIG. 10. It can also be attached to the rear flap 232. The pouch is closed by a closure 236 made of Velcro or similar type material, one of whose functional parts is preferably borne by the fold 235, the other complementary functional part being supported by the opposite flap 232.

The flexible flaps 231, 232 are multi-layered. Preferably, the front flap 231 has an abrasion-resistant outer textile covering 237 and an inner sub-layer of padding 260. The covering 237 is advantageously a kevlar-based textile, selected for its tear and abrasion resistant properties which make it a good surface protection material. The sublayer 260 is preferably made of foam. The inner layer 238 is a textile support layer forming the traction resistant portion of the front flap. It is extended inwardly via the fold 235.

The rear flap 232 also has a support layer 239, preferably external, made from a flexible textile material either having moisture absorbing properties or moisture evacuating properties (ventilation holes provided). The layer 239 is preferably stretchable so as to get adapted to the morphology of the knee. A padding layer 261, such as a foam, can be provided as a lining for the inside of the rear flap. In one potential embodiment, this layer is detachable by being simply kept in place by a second fold 262.

Other support or padding layers could be provided on one or the other of the flaps. As such, it is possible to add a yoke having a hermetically sealed pouch containing a gel in order to locally improve the absorption capacities of the device. The yoke can be stitched impartially on either one of the surfaces of the support layers 238, 239.

The detachable element 24 is preferably made of a rigid or semi-rigid material constituted of plastic or a dense foam. Good results were obtained on selecting a preformed dense polyethylene based foam.

In the example represented, two tightening elements 250, 251 are attached to the flexible body. However, a single element could be envisioned as was the case in the previous embodiments.

The invention is not limited to the particular preferred embodiments described hereinabove, and it can encompass other possible embodiments. For example, an elbow protective device can also be constructed on the same principles as described in the invention.

The invention can find an application in sports other than those cited preferentially, such as snowboarding, hockey, acrobatic skiing, etc.

The instant application is based upon the French Patent Application No. 98 09249, filed on Jul. 16, 1998, the disclosure of which is hereby incorporated by reference thereto in its entirety, and the priority of which is hereby claimed under 35 USC 119.

What is claimed is:

1. A protective device for at least two projecting parts of a limb, which parts extend outwardly in separate angular planes, the device comprising:

a flexible body at least partially surrounding the limb;

a protection element made of a rigid or semi-rigid material locally distributed on the flexible body;

an attachment system for the protection element on the flexible body; and a tightening element to tighten the flexible body around the limb;

wherein the protection element comprises at least one first part and one second part connected together by an articulation allowing a forced adjustment of the parts of the protection element with respect to the projecting parts to be protected when the tightening element is activated during tightening.

2. A protective device as defined by claim 1, wherein the first part and the second part are connected together by at least one section reducing zone.

3. A protective device as defined by claim 1, wherein the tightening element comprises an assembly formed by a strap, a buckle allowing the return of the strap, and a detachable affixing element made of a hook and loop fastening material.

4. A protective device as defined by claim 1, wherein at least a portion of the flexible body covered by the rigid or semi-rigid protection element comprises a padding.

5. A protective device as defined by claim 4, wherein the padding comprises a closed volume filled with a non-compressible, gelled material.

6. A protective device as defined by claim 1, wherein the rigid or semi-rigid protection element is connected to the flexible body by means of loop forming bands fixed to the flexible body and passing through slots provided on the edges of the protection element.

7. A protective device as defined by claim 1, wherein the flexible body is preformed to the general shape of the zone to be protected.

8. A protective device as defined by claim 1, wherein the device is structurally configured to protect the palm and the edge of the hand.

9. A protective device as defined by claim 1, wherein the device is structurally configured to protect the knee cap and the head of the fibula.

10. A protective device adapted to protect the hand, said protective device comprising:

a flexible body having a palm portion and a back portion, at least partially surrounding the user's hand;

a protection element made of a rigid or semi-rigid material locally distributed along the palm portion of the flexible body;

wherein the device is demarcated width-wise by a first transverse edge which is located under the phalangeal joints and a second opposing transverse edge which is located at the wrist joint.

11. A protective device as defined by claim 10, wherein an opening for the passage of the thumb is located at a first junction between the palm portion and the back portion of the flexible body.

12. A protective device as defined by claim 11, wherein the protection element comprises a main portion substantially covering the palm and a side portion located at a second junction between the palm portion and the back portion of the flexible body, which is located in the area of the edge of the hand.

13. A protective device as defined by claim 10, wherein at least a part of the palm portion covered by the rigid or semi-rigid protection element comprises a padding.

14. A protective device as defined by claim 13, wherein the padding comprises a closed volume filled with a non-compressible gelled material.

15. A protective device as defined by claim 10, wherein the rigid or semi-rigid protection element comprises a lower edge located in the vicinity of the wrist joint, curving inwardly so as to form a concave channel extending in the vicinity of said edge and substantially in parallel to said edge.

16. A protective device as defined by claim 15, wherein the channel is extended along the remainder of the protection element by a convex surface in all directions.

17. A protective device as defined by claim 10, wherein the first transverse edge and the second transverse edge of the device flare with respect to one another from the area of the edge of the hand in the direction of the area of the thumb, taking into account in a substantially proportionate manner the widening of the palm of the hand.

18. A protective device as defined by claim 10, wherein the rigid or semi-rigid protection element is connected to the flexible body by means of loop forming bands fixed to the flexible body and passing through slots provided on the edges of the protection element.

19. A protective device adapted to protect the hand while skating comprising:

a flexible body having a palm portion and a back portion, at least partially surrounding the user's hand;

a protection element made of a rigid or semi-rigid material locally distributed along the palm portion of the flexible body;

wherein the device is demarcated width-wise by a first transverse edge which is located under the phalangeal joints and a second opposing transverse edge which is located in the vicinity of the wrist joint;

wherein an opening for the passage of the thumb is located at a first junction between the palm portion and the back portion of the flexible body;

wherein the protection element comprises a main portion substantially covering the palm and a side portion located at a second junction between the palm portion and the back portion of the flexible body, which is located in the area of the edge of the hand; and wherein the main part and the secondary part are connected together by at least one transverse section reducing zone extending from the first transverse edge to the second transverse edge.

20. A protective device adapted to protect the hand while skating comprising:

a flexible body having a palm portion and a back portion, at least partially surrounding the user's hand, the back portion comprising a discontinuity formed by a first end and a second end connected together via a quick attachment system;

a protection element made of a rigid or semi-rigid material locally distributed along the palm portion of the flexible body;

wherein the device is demarcated width-wise by a first transverse edge which is located under the phalangeal joints and a second opposing transverse edge which is located in the vicinity of the wrist joint.

21. A protective device as defined by claim 20, wherein the first end and the second end are connected together by an assembly comprising a strap attached on one of the ends, a buckle attached on the opposing end allowing the strap to return, and a detachable affixing element made of a hook and loop fastening material.

22. A protective device for projecting parts of a knee or wrist, said device comprising:

a flexible body extending at least partially transversely around said knee or wrist;

a protection element made of a rigid or semi-rigid material positioned over and attached to at least a part of said flexible body;

a tightening mechanism to tighten said flexible body around the knee or wrist;

said protection element comprising at least one first part and one second part connected together by an articulation allowing adjustable movement of said parts of said protection element with respect to the projecting parts of a knee or wrist to be protected when the tightening mechanism is caused to tighten said flexible body around the knee or wrist, said first part of said protection element covering at least one of the projecting parts of the knee or wrist and said second part of said protection element covering at least another of the projecting parts of the knee or wrist.

23. A protective device as defined by claim 22 wherein at least a portion of the flexible body covered by said rigid or semi-rigid protection element comprises a padding.

24. A protective device as defined by claim 23, wherein said padding comprises a closed volume filled with a non-compressible, gelled material.

25. A protective device as defined by claim 22, wherein said rigid or semi-rigid protection element at least substantially covers the palm of the hand and an edge area of the hand.

26. A protective device as defined by claim 22, wherein said rigid or semi-rigid protection element at least substantially covers the knee cap and the head of the fibula.

27. A protective device as defined by claim 22, wherein said articulation extends in a direction at least partially longitudinally along the forearm or leg.

28. A protective device as defined by claim 22, further comprising an attachment system for attaching said rigid or semi-rigid material to at least said part of said flexible body.

* * * * *